United States Patent [19]

Dolson et al.

[11] Patent Number: 4,559,427

[45] Date of Patent: Dec. 17, 1985

[54] KEYBOARD SYSTEM AND MODULE THEREFOR

[75] Inventors: Richard G. Dolson, Canton; William R. Brophy, West Simsbury, both of Conn.

[73] Assignee: Veeder Industries, Inc., Hartford, Conn.

[21] Appl. No.: 543,390

[22] Filed: Oct. 19, 1983

[51] Int. Cl.[4] ..... H01H 13/52

[52] U.S. Cl. ..... 200/159 B; 200/5 A; 200/317

[58] Field of Search ..... 200/340, 317, 159 B, 200/5 A; 84/434, 436

[56] References Cited

U.S. PATENT DOCUMENTS

| | | | |
|---|---|---|---|
| 3,916,150 | 10/1975 | Abernethy et al. | 200/340 |
| 3,978,297 | 8/1976 | Lynn et al. | 200/340 |
| 4,360,722 | 11/1982 | Georgopulos | 200/340 |

FOREIGN PATENT DOCUMENTS

| | | | |
|---|---|---|---|
| 3110866 | 9/1982 | Fed. Rep. of Germany | 200/159 B |
| 1496640 | 12/1977 | United Kingdom | 200/5 A |

OTHER PUBLICATIONS

Johnson, Jr., D. O.—IBM Technical Disclosure—vol. 13, No. 7, Dec., 1970—*Keyboard with Changeable Encoding and Key Designation.*

*Primary Examiner*—Stephen Marcus
*Assistant Examiner*—Renee S. Kidorf
*Attorney, Agent, or Firm*—Prutzman, Kalb, Chilton & Alix

[57] ABSTRACT

A keyboard system comprises a circuit board having a matrix of contact switches. A module comprises a matrix of keys in actuating correspondence with the contact switches. The keys are of a resilient elongated form having at the terminus an upwardly projecting contact button and a pair of downwardly projecting pegs. One peg contacts a contact switch for actuation thereof. The other peg is receivable in a recess in the circuit board for maintaining alignment of the key. The module also forms a support for an overlying membrane wherein manual depressing of selective locations of the membrane actuates a corresponding contact switch.

12 Claims, 7 Drawing Figures

KEYBOARD SYSTEM AND MODULE THEREFOR

BACKGROUND OF THE INVENTION

This invention relates to a new and improved keyboard system and module therefor for use in an electronic voting machine. More particularly, this invention relates to a new and improved keyboard system which employs a new and improved module and a membrane having selective locations for manually depressing the membrane thereby actuating a contact switch which communicates with various circuitry for recording and tabulating a vote. A voting console to which the present application is particularly adapted is disclosed in a copending application Ser. No. 543,392, filed Oct. 19, 1983, which is assigned to the assignees of the present invention.

In conventional keyboard systems which employ contact switches integrated into various electronic circuitry, the contact switch generally includes a spring contact which is mounted to the circuit board. A keyboard frame receives a plurality of suitably arranged keys. Each of the keys has an upper keyface which is conventionally affixed with various indicia designating or identifying the key function, and a lowerly disposed portion which contacts against the spring contact. The spring contact is engageable with a button contact in a manner whereby manual depressing of the key against the spring contact actuates the contact switch. The spring contact has sufficient resiliency for returning the depressed key to its normal unactuated position.

In the specific application of keyboard assemblies to the design constraints presented by electronic voting machines, an important consideration is the providing of a relatively large display area for a ballot display as well as a relatively large number of keys corresponding to various candidates and/or issues to be voted. Because the specific configuration of a given ballot is likely to be different for each election and possibly for each voting precinct, it is important that the keyboard system of an electronic voting machine have means for efficiently changing the identification of the key function. In this latter regard, a membrane-type display panel can be advantageously employed to provide both a very functional keyboard system easily adaptable for incorporation into a ballot display and a very attractive aesthetically pleasing ballot display which is "friendly" to the voter. However, because of the relatively large display and keyboard area dictated by the requirements that the ballot including the offices, the instructions, and the names of the candidates be highly visible and the requirement that the keyboard system be highly reliable and responsive to the selection of a voter, unique problems are encountered in the context of an electronic voting machine in providing a keyboard system which is reliable and responsive while also benefitting from the advantages of a membrane display panel. The present invention is particularly directed to a new and improved keyboard system of a type adaptable for use in an electronic voting machine.

BRIEF SUMMARY OF THE INVENTION

Briefly stated, the invention in a preferred form is a keyboard system and module therefor for an electronic voting machine. The keyboard system comprises a circuit board having a matrix of contact switches of a type employing a spring contact. Each of the switches may have an associated light emitting diode and an associated alignment recess in the circuit board. A module is mounted on the circuit board. The module comprises a plurality of upstanding support panels which form a base for a support frame providing means for supporting an overlying membrane. The module further comprises a matrix of keys, each key of which is associated with a corresponding contact switch. Each of the keys comprises an elongated resilient structure which laterally extends from the support frame in an orientation substantially parallel to the circuit board. The key includes an upper contact button, a vertically extending alignment peg which is received in a corresponding alignment recess, and a vertically extending contact peg. The end of the contact peg is depressable against a corresponding spring contact of a contact switch. A membrane overlies the support frame. The membrane preferably has indicia means to indicate the location and designation of each underlying contact button so that depressing a selected location on the membrane results in the actuation of a corresponding contact switch.

The upper contact button of the key projects slightly above the upper surface of the support frame. The matrix board further includes a substantially cylindrical pod for receiving and mounting each light emitting diode. Preferably each key includes a bifurcated connecting prong structure and is provided with a transverse support rib. The module is a unitary molded structure.

An object of the invention is to provide a new and improved keyboard system and module therefor for an electronic voting machine.

Another object of the invention is to provide a new and improved keyboard system employing a membrane having an indicia means wherein keys are actuated by depressing selective locations of the membrane.

Another object of the invention is to provide a new and improved keyboard system which is reliable and responsive and which provides improved means for maintaining alignment of the keys with the contact switches.

Another object of the invention is to provide a new and improved keyboard system which is activated by depressing selective locations of a display membrane and is highly responsive and reliable even though the membrane encompasses a substantially large display area and the system employs a relatively large number of keys.

A further object of the invention is to provide a new and improved keyboard system employing a single integral structure to both support a membrane overlay and provide an actuator key means which contacts against a contact switch.

A yet further object of the invention is to provide a new and improved keyboard system providing selective locations on a display membrane which allow a user to essentially feel a contact button to be depressed.

A yet further object of the invention is to provide a new and improved keyboard system which minimizes the inadvertent activation of more than one contact button.

Other objects and advantages of the invention will become apparent from the detailed description and the drawings.

DETAILED DESCRIPTION

Figure 1:
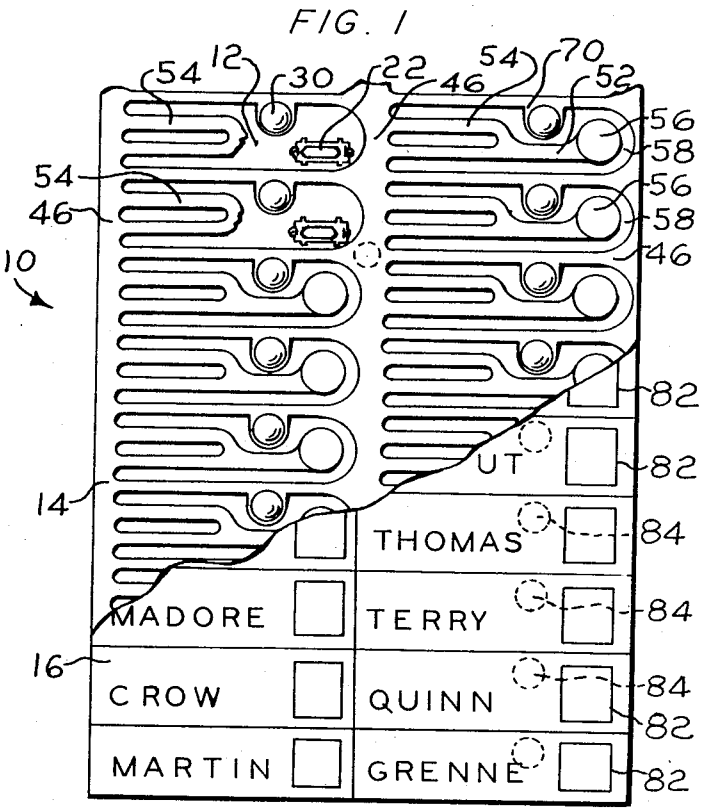
FIG. 1 is a top view of a keyboard system of the present invention, parts of the drawing being broken away to show detail.

With reference to the drawings wherein like numerals represent like parts throughout the several drawings, a keyboard system of the present invention is generally designated by the numeral 10. Keyboard system 10 comprises one or more circuit boards 12 mounting one or more matrix modules 14 which support an overlying membrane 16. Because of the repetitive characteristics of the invention, only representative portions of an entire keyboard system including portions of a single circuit board 12, module 14, and membrane 16 are illustrated in the drawings. Circuit board 12 is printed with various circuitry and mounts various components including contact switches and light emitting diodes. Matrix module 14 mounted to the circuit board comprises an intermediate actuator means for the contact switches and a support for an overlying membrane 16.

A preferred application of the keyboard system 10 is an electronic voting machine such as disclosed in copending application Ser. No. 543,392, filed Oct. 19, 1983, assigned to the assignee of the present invention. Such an electronic voting machine in a preferred form employs circuitry in conjunction with a ballot display area having selective locations or keys providing for a total of 504 possible selections by a voter. The electronic ballot is arranged in a key configuration having 12 columns and 42 rows in each column. A single membrane sheet 16 having dimensions of approximately 25 inches $\times$24 inches is supported by 18 matrix modules 14 which modules are mounted three to a circuit board on six circuit boards. For purposes of describing the keyboard system 10, the description will generally be restricted to a single circuit board 12 and a single matrix module 14, although it should be understood that in preferred applications of the invention, a plurality of circuit boards 12 and matrix modules 14 may be employed.

Figure 4:
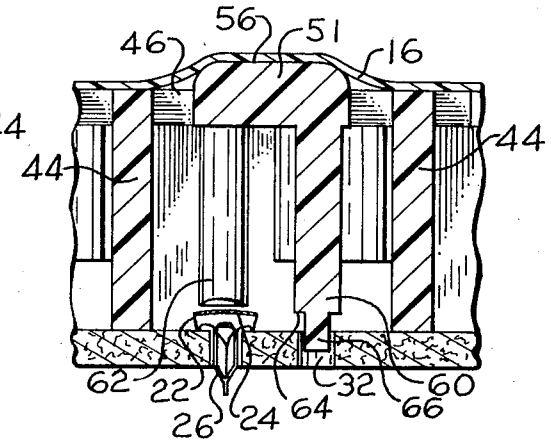
FIG. 4 is another side-sectional view of a portion of the keyboard system of FIG. 1, a key thereof being illustrated in an unactuated position.
Figure 3:
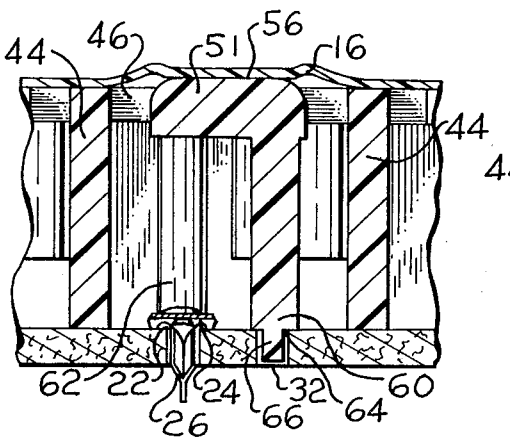
FIG. 3 is a side-sectional view of a portion of the keyboard system of FIG. 1, a key thereof being illustrated in an actuated position.

Circuit board 12 has various printed circuitry, the form of which circuitry is not the focus of the present invention. The circuitry generally functions to record, tabulate, and verify a vote as well as to provide various functions such as to insure for example that only one vote is cast for a given office. Circuit board 12 further incorporates a plurality of contact switches 22 which are arranged to define a matrix of contact switches. Each such contact switch corresponds to a selection location which is designated on the front face of membrane 16 such as a voting box illustrated in FIG. 1. With reference to FIG. 3 and FIG. 4, contact switch 22 may be preferably of a form employing a spring contact 24 which is mounted to the circuit board to overlie a button contact 26. Upon downward depression of spring contact 24, button contact 26 is closed and the contact switch is actuated as illustrated in FIG. 3. Spring contact 24 is preferably made of a material such as relatively thick stainless steel and is highly resilient so that the spring contact returns to its normal undeformed unactuated state out of actuating contact with the button contact when the downward depression forced is removed as illustrated in FIG. 4.

Each contact switch 22 is also preferably associated with a light emitting diode (LED) 30. The light emitting diode is employed to perform various verification functions such as, in a preferred application of the invention, to indicate to a voter that a vote has been provisionally cast for a specific candidate or other similar-type function. An alignment opening 32 is also associated with each contact switch. Alignment opening 32 may be merely a small bore which has been machined into the circuit board 12. Other components, none of which are the subject of the present invention, may also be mounted to circuit board 12.

Figure 2:
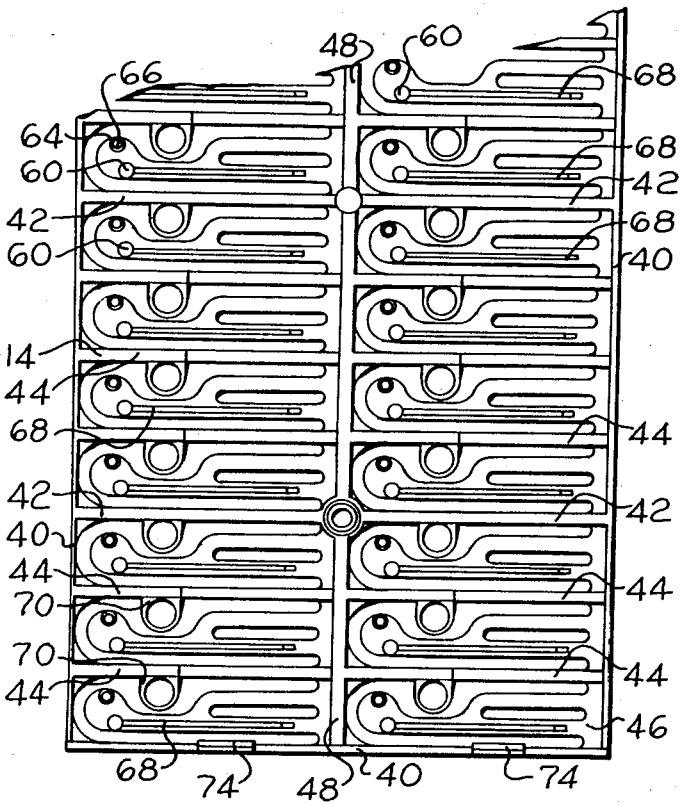
FIG. 2 is a bottom view of a module portion employed in the keyboard system of FIG. 1.
Figure 5:
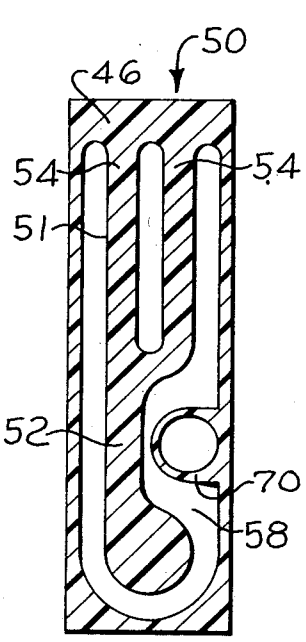
FIG. 5 is a sectional view of one key unit of the keyboard system of FIG. 1.

Matrix module 14 is preferably an integral structure molded from plastic material such as for example Noryl. In a preferred form, matrix module 14 provides support for overlying membrane 16 and also provides an intermediate actuator means for two columns of contact switches 22 having 14 rows in each column. Matrix module 14 in one embodiment is dimensioned to be on the order 4 inches by 8.3 inches by approximately 0.5 inches. With reference to FIG. 2, matrix module 14 comprises a substantially rectangular peripheral support base 40 and a plurality of intermediate support panels 42 and support runners 44. Support base 40, panels 42, and runners 44 provide an upstanding support structure which extends from circuit board 12 to an upper flat skeletal support frame 46 parallel to circuit board 12. Membrane 16 overlies frame 46 to contact against the upper surface of frame 46. Matrix module 14 interiorly forms a substantially hollow space which is adapted to accommodate components which may be mounted above the surface of circuit board 12. In order to provide for the accommodation of such components, support runners 44 transversely extend interiorly only a fraction of the distance between the sides of the support base. In order to provide an efficient intermediate structural support for matrix module 14, support panels 42 preferably alternate with every two or three runners 44 to essentially extend from each side of the support base 40 to intermediately intersect with a central support panel 48. Central support panel 48 generally coincides with the demarcation between the two columns of intermediate actuator means as will be described below.

Matrix module 14 further forms a matrix of a plurality of identical actuator or key units generally denoted by the numeral 50. Each key unit 50 includes a key 51 generally positioned above a corresponding contact switch 22 fixed to the circuit board 12. The function of the key is to provide an intermediate actuating means for transferring a key depression applied to the face of membrane 16 to actuate a contact switch 22 such as, for example in a preferred application, to record a vote for a specific candidate.

Key 51 comprises an elongated finger-like projection 52 extending from a bifurcated prong structure 54 which integrally projects from frame 46 at the top of the module. Projection 52 and prong structure 54 form a resilient spring-like structure wherein the upper surface in a normal state coincides with the upper surface of support frame 46. A circular contact button 56 is formed at the top at the outer terminus of projection 52. Contact button 56 preferably projects slightly above support frame 46. In a preferred embodiment, contact button 56 projects approximately 0.040 inches above the upper surface of support frame 46.

Key 51 may be described as transversely projecting into an opening 58 which is generally dimensioned to partially accommodate a portion of a finger tip downwardly depressed against a portion of membrane 16 overlying contact button 56.

With further reference to FIG. 2, FIG. 3, and FIG. 4, an alignment peg 60 and a contact peg 62 extend downwardly from the underside of key 51 in generally parallel vertical relationship. Alignment peg 60 and contact peg 62 are offset from a vertical axis through the center of contact button 56. Alignment peg 60 aligns with alignment opening 32 in the circuit board 12. In a preferred embodiment, alignment peg 60 has a circumferential lip 64 which bears against the portion of the circuit board adjacent alignment opening 32 to form a stop as illustrated in FIG. 3. Lip 64 thus acts to define the downward position limit of key 51 thereby essentially limiting the degree of depression of the integral key 51. A location projection 66 of reduced diameter relative to the rest of peg 60 is received in alignment opening 32. The alignment peg functions to maintain the alignment of the key 51 with the contact switch 22 and to reduce the tendency for warpage or sideways deformation of the key, and thus provides for increased reliability and accuracy of response in the actuation of key 51.

Contact peg 62 is longitudinally dimensioned so that a moderate degree of depression of the key will result in the end of the contact peg engaging against spring contact 24 thus actuating contact switch 22. It is critical that contact peg 62 align with its corresponding contact switch 22. With reference to FIGS. 3, 4, 6, and 7, the contact end of contact peg 62 is preferably a rounded surface substantially shaped like the surface of a portion of a cylinder. The contact surface is oriented so that the longitudinal axis of the cylindrical surface is orthogonal to the longitudinal axis of the contact 24. It is believed the latter configuration is more reliable from an alignment standpoint than the spherical contact surfaces conventionally employed on conventional floating key-type keyboard systems. A rib 68 may also be provided on the underside of the key 51 to increase the structural rigidity of the key Each key of the matrix module 14 is positioned for actuation with corresponding contact switch 22 mounted on the circuit board 12. The specific key configuration and the plastic material of the matrix module 14 provide for a key having a natural resilience which is responsive to a moderate depression force applied to contact button 56 by, for example, a fingertip to actuate the contact switch. The resilience of the key allows for the key to essentially spring back into a normal state wherein the top surface is essentially parallel to the upper surface of the support frame 46. The force required to depress a key which is not in contact with a contact switch is normally less than the corresponding force required to actuate the contact switch. Similarly, the resilience of the spring contact 24 provides a greater degree of response to return the spring contact to the normal undeformed unactuated state than does the resilience of the key acting alone to return the key to the normal unactuated state.

Each key unit 50 is also preferably provided with a substantially cylindrical pod 70. Pod 70 mounts an LED 30 and/or directs light from LED 30. Each LED functions to verify that a given contact switch has been activated and/or not activated in accordance with pre-established guidelines such as for example to indicate whether or not a vote has been cast for a particular candidate or for each office. Preferably, the light emitting diode 30 is positioned so as to be conspicuous and also not detract from the ballot indicia or interfere with the selective location which is depressed by the voter for recording a vote. Key 51 is accordingly shaped and dimensioned to accommodate the positioning of pod 70 in opening 58.

Figure 6:
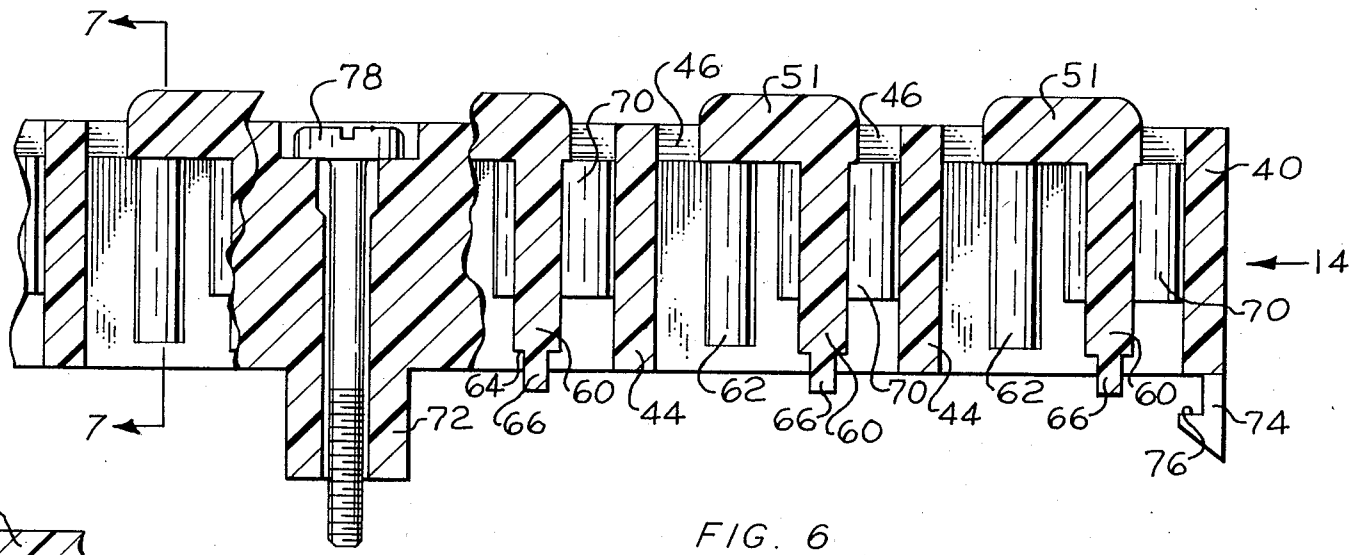
FIG. 6 is a side-sectional view of a portion of a module employed in the keyboard system of FIG. 1, parts of the drawing being broken away.
Figure 7:
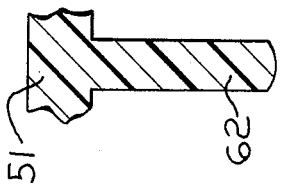
FIG. 7 is a sectional view of a portion of the module of FIG. 6 taken along the line 7—7.

With reference to FIG. 6, matrix module 14 may be accurately located on a printed circuit board and/or a support panel of a voting console by means of downwardly protruding central bosses 72 (only one illustrated). Bosses 72 are closely received in corresponding location recesses (not illustrated) which are accurately located in the circuit board 12. The matrix module may be secured to the circuit board by resilient clips 74 positioned at opposing ends of circuit board 14 and downwardly extending from base 40. The clips 74 have a horizontally disposed edge 76 which engages the underside of circuit board 12. The matrix module 14 may also be further secured in place by a fastener 78 which is received in a central bore of boss 74 and tightened against the matrix module.

Membrane 16 is a relatively thin plastic sheet having a thickness on the order of 0.010–0.014 inches. Membrane 16 may be formed of Lexan or Mylar. With specific reference to FIG. 1, FIG. 3 and FIG. 4, membrane 16 closely contacts against the upper surface of the support frame 46 of matrix module and closely follows the contours of matrix module 14 so that the portions of the membrane overlying the contact buttons 56 each form a slight dimple or raised contour at the outer face of membrane 16. It should be noted that the dimple-like effect is somewhat exaggerated for purposes of illustration in the drawing of FIG. 3 and FIG. 4. The slight dimpling effect allows for the user, i.e., the voter, to "feel" the selective locations of the membrane which are depressable to activate a contact switch so as to record a vote. It is desirable that the membrane 16 be a relatively thin sheet so that a single contact switch is highly responsive to a depression against predetermined selective locations at the outer face of the membrane. If the membrane is too stiff, the depressing of a single selective location on the membrane may result in the actuation more than one key or contact button, and hence the inadvertent actuation of more than one contact switch. Naturally, if the membrane is too thin, then the membrane may have a tendency to wrinkle, to move out of alignment, and to present an unsightly appearance.

The membrane 16 is affixed at the outer surface with various indicia designated generally by the numeral 80. Indicia 80 is preferably indicia relating to a ballot display which may, for example, identify the office and the candidates for the office, and also provide instructions relative to voting for each office. Each candidate for an office or each issue to be voted upon is designated by the indicia means and located on the membrane to generally align with a corresponding key and actuator unit 50 of matrix module 14, and to consequently align with a contact switch 22 and LED 30 of the circuit board 12. The membrane may have further indicia such as a box 82 which aligns with the contact button 56 of the key to indicate the selective location on membrane 16 which is to be depressed to record a selection.

The membrane is translucent enough so that light emitted from LED 30 is visible at a selective location such as area 84 shown in phantom in FIG. 1. As previously indicated, various circuitry may be provided to activate the LED when a vote has been cast or in accordance with other pre-established conditions. It of course maybe appreciated that the keyboard assembly of the present invention may have a wide range of applicability to general keyboard applications. In particular, the keyboard system of the present invention is directed to applications wherein a relatively large number of keys may be required and a relatively large keyboard area may be required. The employing of a membrane-type overlay provides both an attractive appearance and an advantageous means for changing the key function designations by merely reprogramming the circuitry and replacing the membrane 16 with a membrane having indicia adapted for the specific application. It should be noted that ballot configurations as well as the candidates and offices frequently change from election to election. It is desirable for such applications to employ a keyboard system wherein the system is reliable and friendly to the voter while at the same time the system functions may be relatively easily modified or changed in accordance with the requirements of each election.

The foregoing description has been set forth for purposes of illustration and should not be deemed a limitation of the present invention. Accordingly, various modifications, adaptations and alternatives may occur to one skilled in the art without departing from the spirit and scope of the present invention.

What is claimed is:

1. A keyboard system for an electronic voting machine or the like comprising:

a circuit board having a matrix of contact switches of a type employing a spring contact, each of said switches being associated with a corresponding alignment recess in said circuit board;

a matrix module mounted to said circuit board, said matrix module comprising a base, an upper support frame, and a matrix of keys, each key being associated with a corresponding contact switch and comprising an elongated resilient structure extending substantially parallel to the circuit board, said key including an upper contact button, a vertically extending alignment peg received in a corresponding alignment recess, and a vertically extending contact peg, the end of which is depressable against a corresponding spring contact of a contact switch; and a membrane overlying said support frame wherein depressing of a selected location of said membrane results in the actuation of a corresponding contact switch.

2. The keyboard system of claim 1 wherein the upper contact button of the matrix module projects slightly above the support frame.

3. The keyboard system of claim 1 wherein a light emitting diode is associated with at least one contact switch and the matrix module further includes a substantially cylindrical pod for receiving each light emitting diode.

4. The keyboard system of claim 1 wherein said keys have a bifurcated prong structure adjacent a portion of the support frame which connects with the key.

5. The keyboard system of claim 1 wherein said keys further include a transverse support rib.

6. The keyboard system of claim 1 wherein the matrix module is secured to the circuit board by means of resilient clips projecting from the base.

7. The keyboard system of claim 1 wherein the matrix module is an integral molded structure.

8. A keyboard system for an electronic voting machine or the like comprising:

a circuit board having a matrix of contact switches;

a module generally positioned above said circuit board, said module comprising a matrix of key means to actuate a corresponding contact switch and support means to support an overlying membrane;

said key means comprising a resilient structure projecting generally parallel to said circuit board, a contact means for actuating the contact switch in response to a manual depression of a selective location of the membrane, and an alignment means comprising a peg adapted to be received in an alignment recess in the circuit board to maintain the alignment of the contact means with a corresponding contact switch.

9. The keyboard system of claim 8 wherein the module is an integral molded structure.

10. The keyboard system of claim 8 wherein the contact means includes a contact button which projects upwardly slightly above the support means.

11. The keyboard system of claim 8 wherein the contact means includes a contact peg which is actuable for generally vertical movement relative to the circuit board to contact against a contact switch.

12. The keyboard system of claim 11 wherein said contact peg terminates in a rounded surface substantially shaped like the surface of a portion of a cylinder.

* * * * *